US011268437B2

(12) United States Patent
Gautier et al.

(10) Patent No.: US 11,268,437 B2
(45) Date of Patent: Mar. 8, 2022

(54) ECCENTRIC SHAFT SPEED CHANGE MECHANISM

(71) Applicant: GM Global Technology Operations LLC, Detroit, MI (US)

(72) Inventors: Erwan Gautier, Franklin, MI (US); Justin Ketterer, LaSalle (CA); Ryan Heinbuch, Commerce Township, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 199 days.

(21) Appl. No.: 16/375,423

(22) Filed: Apr. 4, 2019

(65) Prior Publication Data

US 2020/0318535 A1 Oct. 8, 2020

(51) Int. Cl.
*F02B 75/04* (2006.01)

(52) U.S. Cl.
CPC ..... *F02B 75/048* (2013.01)

(58) Field of Classification Search
CPC .... F02B 75/048; F02B 75/045; F02B 75/047; F02D 15/02; F02D 15/00; F01B 31/14
USPC ..... 123/48 B
See application file for complete search history.

(56) References Cited

U.S. PATENT DOCUMENTS

| | | | | |
|---|---|---|---|---|
| 8,794,200 | B2 | 8/2014 | Jacques et al. | |
| 2004/0083992 | A1* | 5/2004 | Nohara | F02D 15/02 123/78 E |
| 2014/0137824 | A1* | 5/2014 | Jacques | F02B 75/048 123/90.17 |
| 2017/0284542 | A1* | 10/2017 | Takahashi | B60W 10/026 |

FOREIGN PATENT DOCUMENTS

| | | | |
|---|---|---|---|
| DE | 102009006633 | A1 | 8/2010 |
| DE | 102011108185 | A1 | 1/2013 |
| JP | 2009085187 | A | 4/2009 |

* cited by examiner

*Primary Examiner* — Lindsay M Low
*Assistant Examiner* — Omar Morales
(74) *Attorney, Agent, or Firm* — Vivacqua Crane PLLC

(57) ABSTRACT

A crankshaft is rotatably supported by an engine block and rotatable about a crank axis. An eccentric shaft is rotatably supported within the engine and rotatable about an eccentric shaft axis, wherein the eccentric shaft axis is parallel to and distal from the crank axis. A speed change mechanism interlinks movement of the eccentric shaft and the crankshaft. The speed change mechanism selectively varies a ratio of a rotational speed of the eccentric shaft relative to a rotational speed of the crankshaft from 1:1 to one of: −8:1, −6:1, −4:1, −2:1, −1:1, −0.5:1, 0:1, 0.5:1, 1:1, 2:1, 4:1, 6:1, and 8:1, thereby causing the eccentric shaft to rotate at a speed different from the crankshaft and varying a rotational position of the eccentric shaft relative to the crankshaft.

17 Claims, 5 Drawing Sheets

ECCENTRIC SHAFT SPEED CHANGE MECHANISM

INTRODUCTION

The present disclosure relates to an internal combustion engine having the ability to operate with the advantages of the Atkinson cycle and also provide the ability to vary the compression ratio of the engine.

Internal combustion engines operating on an Atkinson cycle are known. An engine operating on an Atkinson cycle has a compression stroke length that is less than the expansion stroke length, during both high load and high engine speed conditions and low load and low engine speed conditions. This provides fuel economy benefits.

In addition to operating on an Atkinson cycle, it is advantageous to be able to change the compression ratio of an internal combustion engine. While the ability to do this exists, technologies allowing this can add cost and weight to a vehicle and increase packaging requirements for the engine.

Thus, while current technologies achieve their intended purpose, there is a need for a new and improved internal combustion engine that provides the benefits of operating on an Atkinson cycle and provides the ability to selectively vary the compression ratio of the engine.

SUMMARY

According to several aspects of the present disclosure, an internal combustion engine includes an engine block defining a cylinder bore. A piston is slidably supported within the cylinder bore. The piston slides reciprocally within the cylinder bore throughout an engine cycle, including a piston compression stroke having a compression stroke length and a piston expansion stroke having an expansion stroke length. A crankshaft is rotatably supported by the engine block and rotatable about a crank axis. An eccentric shaft is rotatably supported within the engine and rotatable about an eccentric shaft axis, wherein the eccentric shaft axis is parallel to and distal from the crank axis. A speed change mechanism interlinks movement of the eccentric shaft and the crankshaft. The speed change mechanism selectively varies a ratio of a rotational speed of the eccentric shaft relative to a rotational speed of the crankshaft from 1:1 to one of: −8:1, −6:1, −4:1, −2:1, −1.1, −0.5:1, 0:1, 0.5:1, 1:1, 2:1, 4:1, 6:1, and 8:1, thereby causing the eccentric shaft to rotate at a speed different from the crankshaft and varying a rotational position of the eccentric shaft relative to the crankshaft.

In another aspect of the present disclosure the speed change mechanism includes a clutch rotatably engaged with the eccentric shaft, and a drive element rotatably engaged with the crankshaft. The clutch selectively rotatably engages the eccentric shaft and the drive element to transfer rotation of the crankshaft to the eccentric shaft, and the drive element varies the ratio of the rotational speed of the eccentric shaft relative to the crankshaft.

In yet another aspect of the present disclosure the clutch is an interference clutch including a clutch actuator and a clutch plate. The clutch plate is disposed coaxially on the eccentric shaft between a stationary ground element and a drive element of the engine. The clutch actuator adapted to move the clutch plate axially along the eccentric shaft between a first position and a second position. The clutch further includes a first synchronizer mounted onto the clutch plate, and facing the stationary ground element, and a second synchronizer mounted onto the clutch plate, and facing the drive element of the engine. The clutch further includes one or more interference elements extending outward from the clutch plate. The clutch actuator selectively moves the clutch plate between a first position and a second position. When the clutch actuator moves the clutch plate into the first position, the clutch actuator moves the clutch plate toward the stationary ground element, and the first synchronizer frictionally engages the stationary ground element to synchronize the rotational speed of the eccentric shaft to the rotational speed of the stationary ground element. At least one of the interference elements engages the stationary ground element to rotationally lock the eccentric shaft to the stationary ground element. When the clutch actuator moves the clutch plate to the second position, the clutch actuator moves the clutch plate toward the drive element of the engine. The second synchronizer frictionally engages the drive element of the engine to synchronize the rotational speed of the eccentric shaft to the rotational speed of the drive element of the engine, and at least one of the interference elements engages the drive element to rotationally lock the eccentric shaft to the drive element. The rotational speed of the drive element of the engine is greater than the rotational speed of the stationary ground element.

In still another aspect of the present disclosure the rotational speed of the stationary ground element is zero, and the rotational speed of the drive element of the engine is one half the rotational speed of the crankshaft.

In a yet aspect of the present disclosure the drive element further includes a phaser that selectively adjusts a rotational position of the eccentric shaft relative to the crankshaft and infinitely adjusts a compression ratio of the internal combustion engine between a first predetermined compression ratio and a second predetermined compression ratio greater than the first predetermined compression ratio.

In still another aspect of the present disclosure the drive element further includes a gearbox and a phaser. The gearbox is disposed on and coaxial with the eccentric shaft and selectively rotates the eccentric shaft at a rotational speed that is one of: one half of the rotational speed of the crankshaft, and the same as the rotational speed of the crankshaft. The phaser is disposed on and coaxial with the eccentric shaft, and selectively alters a rotational position of the eccentric shaft relative to a rotational position of the crankshaft to adjust a compression ratio of the internal combustion engine.

In yet another aspect of the present disclosure the phaser adjusts a stroke length and a top dead center position of the piston inside the cylinder bore between at least a first length with a first top dead center position and a second length with a second top dead center position. The first length is smaller than the second length. The first top dead center position is between the second top dead center position and the crankshaft. The first length defines a first predetermined compression ratio and the second length defines a second predetermined compression ratio greater than the first predetermined compression ratio. The gearbox is one of a harmonic drive, a planetary gearset, and a roller reducer.

In still another aspect of the present disclosure the drive element further includes a gearbox rotatably supported by the engine block and coaxial with the eccentric shaft and a clutch housing supported coaxially on the eccentric shaft. The drive element further includes a clutch plate rotatably engaged with the eccentric shaft and moveable axially along the eccentric shaft within the clutch housing. The clutch plate includes at least one interference element extending outward from the clutch plate, and a clutch actuator adapted to move the clutch plate axially along the eccentric shaft within the clutch housing. The clutch actuator selectively moves the clutch plate between a first position and a second position. In the first position, the at least one interference element of the clutch plate engages with the clutch housing in a first rotational orientation and eliminates a difference in rotational speed between the eccentric shaft and the clutch housing. In the second position, the at least one interference element of the clutch plate engages with the clutch housing in a second rotational orientation and eliminates a difference in rotational speed between the eccentric shaft and the clutch housing. The gearbox selectively rotates the eccentric shaft at a rotational speed that is one of: one half of the rotational speed of the crankshaft, and the same as the rotational speed of the crankshaft.

In yet another aspect of the present disclosure the phaser adjusts a stroke length and a top dead center position of the piston inside the cylinder bore between at least a first length with a first top dead center position and a second length with a second top dead center position. The first length is smaller than the second length. The first top dead center position is between the second top dead center position and the crankshaft. The first length defines a first predetermined compression ratio and the second length defines a second predetermined compression ratio greater than the first predetermined compression ratio. The gearbox is one of a harmonic drive, a planetary gearset, and a roller reducer.

In still another aspect of the present disclosure the drive element further includes an input shaft rotatably supported by the engine block and parallel to the eccentric shaft, a plurality of input shaft gears rotatably disposed on the input shaft, and a clutch plate disposed coaxially on the input shaft axially between the plurality of input shaft gears. The clutch plate includes one or more interference elements extending outward from the clutch plate. A first synchronizer is disposed on the clutch plate and facing a first of the plurality of input shaft gears, and a second synchronizer is disposed on the clutch plate opposite the first synchronizer and facing a second of the plurality of input shaft gears. A plurality of eccentric shaft gears is disposed on the eccentric shaft. Each of the plurality of input shaft gears is enmeshed with one of the plurality of eccentric shaft gears and defines a plurality of enmeshed input shaft gear and eccentric gear pairs. Each enmeshed input shaft gear and eccentric shaft gear pair is adapted to transfer rotational motion from the input shaft to the eccentric shaft at a predetermined gear ratio. The drive element further includes a clutch actuator adapted to selectively move the clutch plate axially along the input shaft between a first position and a second position. In the first position the first synchronizer frictionally engages the first input shaft gear to synchronize a rotational speed of the input shaft to a rotational speed of the first input shaft gear, and at least one of the interference elements engages the first input shaft gear to rotationally lock the input shaft to the first input shaft gear. The clutch actuator moves the clutch plate to the second position. The clutch actuator moves the clutch plate towards the second input shaft gear and the second synchronizer frictionally engages the second input shaft gear to synchronize a rotational speed of the input shaft to a rotational speed of the second input shaft gear. At least one of the interference elements engages the second input shaft gear to rotationally lock the input shaft to the second input shaft gear, wherein rotational motion of the input shaft is transferred through the one of the plurality of input shaft gears to the enmeshed one of the plurality of eccentric shaft gears, and to the eccentric shaft. A first of the plurality of enmeshed input shaft gear and eccentric shaft gear pairs rotates the eccentric shaft at one half of the rotational speed of the crankshaft, and a second of the plurality enmeshed input shaft gear and eccentric gear pairs rotates the eccentric shaft at the same rotational speed as the crankshaft.

In still another aspect of the present disclosure an internal combustion engine includes an engine block defining a cylinder bore, a piston slidably supported within the cylinder bore. The piston slides reciprocally within the cylinder bore throughout an engine cycle, including a piston compression stroke having a compression stroke length and a piston expansion stroke having an expansion stroke length. A crankshaft is rotatably supported by the engine block and rotatable about a crank axis, and an eccentric shaft is rotatably supported within the engine and rotatable about an eccentric shaft axis. The eccentric shaft axis is parallel to and distal from the crank axis. A speed change mechanism interlinks movement of the eccentric shaft and the crankshaft and includes a clutch rotatably engaged with the eccentric shaft. A drive element is rotatably engaged with the crankshaft. The clutch selectively rotatably engages the eccentric shaft and the drive element to transfer rotation of the crankshaft to the eccentric shaft, and the drive element selectively varies a ratio of a rotational speed of the eccentric shaft relative to a rotational speed of the crankshaft from 1:1 to one of: −8:1, −6:1, 4:1, −2:1, −1:1, −0.5:1, 0:1, 0.5:1, 1:1, 2:1, 4:1, 6:1, and 8:1, thereby causing the eccentric shaft to rotate at a speed different from the crankshaft and varying a rotational position of the eccentric shaft relative to the crankshaft.

In still another aspect of the present disclosure the clutch is an interference clutch including a clutch actuator, and a clutch plate disposed coaxially on the eccentric shaft between a stationary ground element and a drive element of the engine. The clutch actuator is adapted to move the clutch plate axially along the eccentric shaft between a first position and a second position. A first synchronizer mounted onto the clutch plate, facing the stationary ground element, and a second synchronizer is mounted onto the clutch plate, facing the drive element of the engine. One or more interference elements extend outward from the clutch plate. The clutch actuator selectively moves the clutch plate between the first position and the second position. When the clutch actuator moves the clutch plate into the first position, the clutch actuator moves the clutch plate toward the stationary ground element. The first synchronizer frictionally engages the stationary ground element to synchronize the rotational speed of the eccentric shaft to the rotational speed of the stationary ground element. At least one of the interference elements engages the stationary ground element to rotationally lock the eccentric shaft to the stationary ground element, and the clutch actuator moves the clutch plate to the second position. The clutch actuator moves the clutch plate toward the drive element of the engine, the second synchronizer frictionally engages the drive element of the engine to synchronize the rotational speed of the eccentric shaft to the rotational speed of the drive element of the engine, and at least one of the interference elements engages the drive element to rotationally lock the eccentric shaft to the drive element. The rotational speed of the drive element of the engine is greater than the rotational speed of the stationary ground element.

In still another aspect of the present disclosure the rotational speed of the stationary ground element is zero, and the rotational speed of the drive element of the engine is one half the rotational speed of the crankshaft.

In still another aspect of the present disclosure the drive element further includes a phaser that selectively adjusts a rotational position of the eccentric shaft relative to the crankshaft and infinitely adjusts a compression ratio of the internal combustion engine between a first predetermined compression ratio and a second predetermined compression ratio greater than the first predetermined compression ratio.

In still another aspect of the present disclosure the drive element further includes a gearbox and a phaser. The gearbox is disposed on and coaxial with the eccentric shaft and selectively rotates the eccentric shaft at a rotational speed that is one of: one half of the rotational speed of the crankshaft, and the same as the rotational speed of the crankshaft. The phaser is disposed on and coaxial with the eccentric shaft, and selectively alters a rotational position of the eccentric shaft relative to a rotational position of the crankshaft to adjust a compression ratio of the internal combustion engine.

In yet another aspect of the present disclosure the phaser adjusts a stroke length and a top dead center position of the piston inside the cylinder bore between at least a first length with a first top dead center position and a second length with a second top dead center position. The first length is smaller than the second length. The first top dead center position is between the second top dead center position and the crankshaft. The first length defines a first predetermined compression ratio and the second length defines a second predetermined compression ratio greater than the first predetermined compression ratio. The gearbox is one of a harmonic drive, a planetary gearset, and a roller reducer.

In still another aspect of the present disclosure the drive element further includes a gearbox rotatably supported by the engine block and coaxial with the eccentric shaft and a clutch housing supported coaxially on the eccentric shaft. The drive element further includes a clutch plate rotatably engaged with the eccentric shaft and moveable axially along the eccentric shaft within the clutch housing. The clutch plate includes at least one interference element extending outward from the clutch plate, and a clutch actuator adapted to move the clutch plate axially along the eccentric shaft within the clutch housing. The clutch actuator selectively moves the clutch plate between a first position and a second position. In the first position, the at least one interference element of the clutch plate engages with the clutch housing in a first rotational orientation and eliminates a difference in rotational speed between the eccentric shaft and the clutch housing. In the second position, the at least one interference element of the clutch plate engages with the clutch housing in a second rotational orientation and eliminates a difference in rotational speed between the eccentric shaft and the clutch housing. The gearbox selectively rotates the eccentric shaft at a rotational speed that is one of: one half of the rotational speed of the crankshaft, and the same as the rotational speed of the crankshaft.

In yet another aspect of the present disclosure the phaser adjusts a stroke length and a top dead center position of the piston inside the cylinder bore between at least a first length with a first top dead center position and a second length with a second top dead center position. The first length is smaller than the second length. The first top dead center position is between the second top dead center position and the crankshaft. The first length defines a first predetermined compression ratio and the second length defines a second predetermined compression ratio greater than the first predetermined compression ratio. The gearbox is one of a harmonic drive, a planetary gearset, and a roller reducer.

In still another aspect of the present disclosure the drive element further includes an input shaft rotatably supported by the engine block and parallel to the eccentric shaft, and a plurality of input shaft gears rotatably disposed on the input shaft. The drive element further includes a clutch plate disposed coaxially on the input shaft axially between the plurality of input shaft gears. The clutch plate includes one or more interference elements extending outward from the clutch plate. A first synchronizer is disposed on the clutch plate and facing a first of the plurality of input shaft gears, and a second synchronizer is disposed on the clutch plate opposite the first synchronizer and facing a second of the plurality of input shaft gears. A plurality of eccentric shaft gears is disposed on the eccentric shaft. Each of the plurality of input shaft gears is enmeshed with one of the plurality of eccentric shaft gears, defining a plurality of enmeshed input shaft gear and eccentric gear pairs. Each enmeshed input shaft gear and eccentric shaft gear pair is adapted to transfer rotational motion from the input shaft to the eccentric shaft at a predetermined gear ratio. The drive element further includes a clutch actuator adapted to selectively move the clutch plate axially along the input shaft between a first position and a second position. In the first position the first synchronizer frictionally engages the first input shaft gear to synchronize a rotational speed of the input shaft to a rotational speed of the first input shaft gear, and at least one of the interference elements engages the first input shaft gear to rotationally lock the input shaft to the first input shaft gear. The clutch actuator moves the clutch plate to the second position, and the clutch actuator moves the clutch plate towards the second input shaft gear and the second synchronizer frictionally engages the second input shaft gear to synchronize a rotational speed of the input shaft to a rotational speed of the second input shaft gear. At least one of the interference elements engages the second input shaft gear to rotationally lock the input shaft to the second input shaft gear. Rotational motion of the input shaft is transferred through the one of the plurality of input shaft gears to the enmeshed one of the plurality of eccentric shaft gears, and to the eccentric shaft. A first of the plurality of enmeshed input shaft gear and eccentric shaft gear pairs rotates the eccentric shaft at one half of the rotational speed of the crankshaft, and a second of the plurality enmeshed input shaft gear and eccentric gear pairs rotates the eccentric shaft at the same rotational speed as the crankshaft.

In still another aspect of the present disclosure an internal combustion engine includes an engine block defining a cylinder bore, and a piston slidably supported within the cylinder bore. The piston slides reciprocally within the cylinder bore throughout an engine cycle, including a piston compression stroke having a compression stroke length and a piston expansion stroke having an expansion stroke length. A crankshaft is rotatably supported by the engine block and rotatable about a crank axis. An eccentric shaft is rotatably supported within the engine and rotatable about an eccentric shaft axis. The eccentric shaft axis is parallel to and distal from the crank axis. An input shaft is rotatably supported by the engine block and parallel to the eccentric shaft. A plurality of input shaft gears is rotatably disposed on the input shaft, and a clutch plate is disposed coaxially on the input shaft axially between the plurality of input shaft gears. The clutch plate includes one or more interference elements extending outward from the clutch plate. A first synchronizer is disposed on the clutch plate and facing a first of the plurality of input shaft gears, and a second synchronizer is disposed on the clutch plate opposite the first synchronizer and facing a second of the plurality of input shaft gears. A plurality of eccentric shaft gears is disposed on the eccentric shaft. Each of the plurality of input shaft gears is enmeshed with one of the plurality of eccentric shaft gears, defining a plurality of enmeshed input shaft gear and eccentric gear pairs. Each enmeshed input shaft gear and eccentric shaft gear pair is adapted to transfer rotational motion from the input shaft to the eccentric shaft at a predetermined gear ratio. A clutch actuator is adapted to selectively move the clutch plate axially along the input shaft between a first position and a second position. In the first position the first synchronizer frictionally engages the first input shaft gear to synchronize a rotational speed of the input shaft to a rotational speed of the first input shaft gear, and at least one of the interference elements engages the first input shaft gear to rotationally lock the input shaft to the first input shaft gear. The clutch actuator moves the clutch plate to the second position, and the clutch actuator moves the clutch plate towards the second input shaft gear and the second synchronizer frictionally engages the second input shaft gear to synchronize a rotational speed of the input shaft to a rotational speed of the second input shaft gear. At least one of the interference elements engages the second input shaft gear to rotationally lock the input shaft to the second input shaft gear. Rotational motion of the input shaft is transferred through the one of the plurality of input shaft gears to the enmeshed one of the plurality of eccentric shaft gears, and to the eccentric shaft. A first of the plurality of enmeshed input shaft gear and eccentric shaft gear pairs rotates the eccentric shaft at one half of the rotational speed of the crankshaft, and a second of the plurality enmeshed input shaft gear and eccentric gear pairs rotates the eccentric shaft at the same rotational speed as the crankshaft.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1:
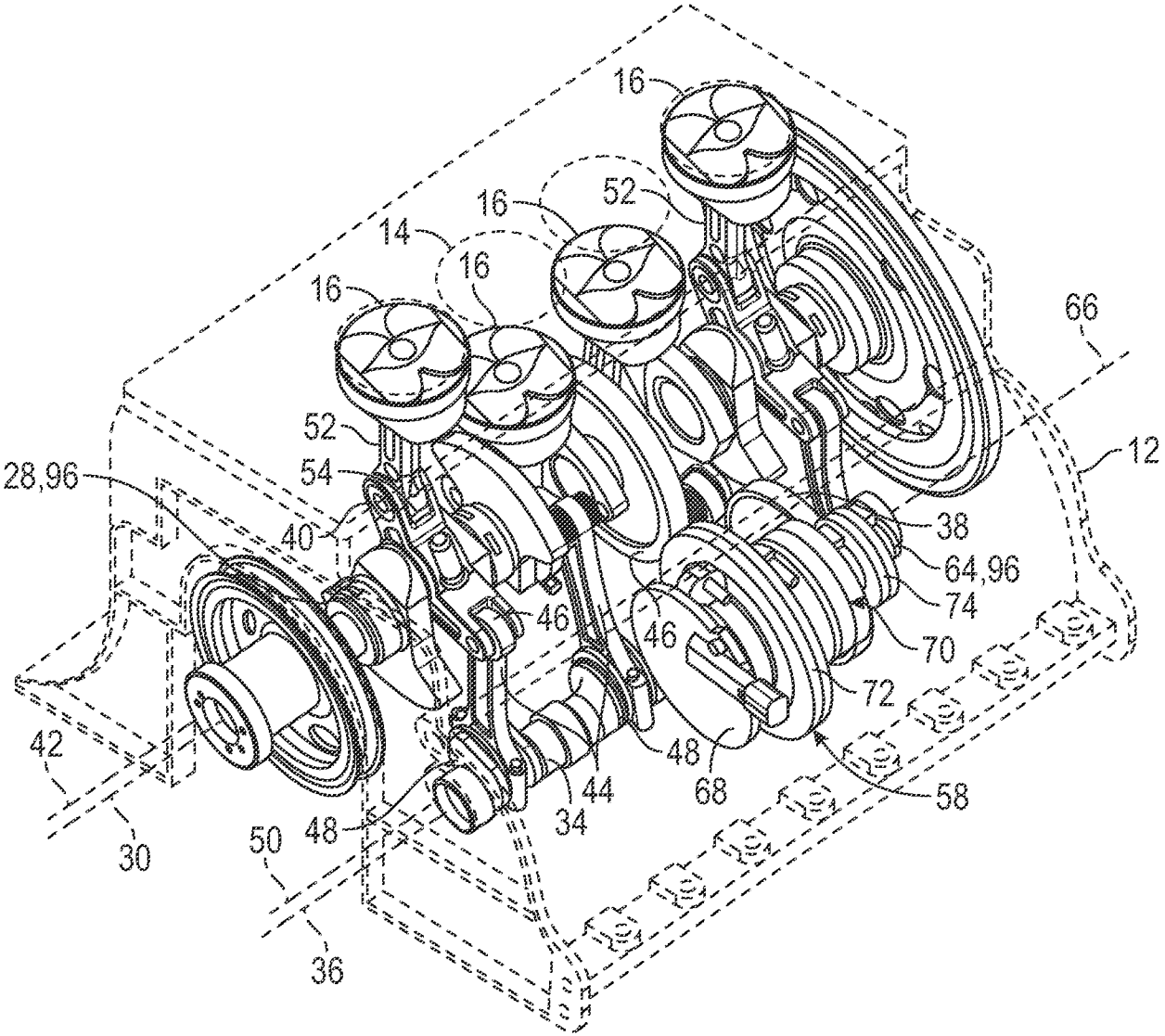
FIG. 1 is a perspective view of an internal combustion engine according to an exemplary embodiment, with the engine block shown partially broken away.
Figure 2:
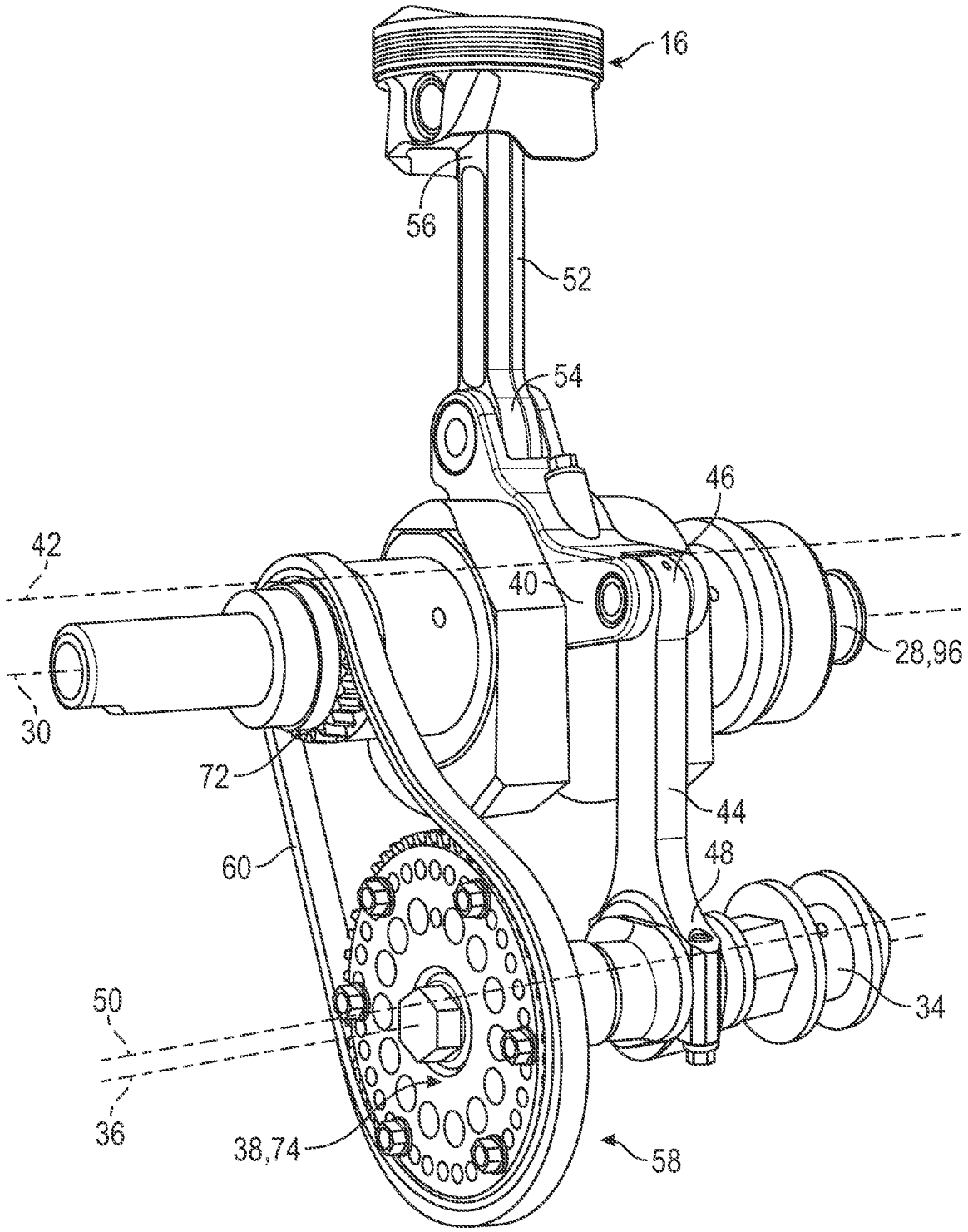
FIG. 2 is perspective view of a portion of the internal combustion engine of FIG. 1 and showing a drive element for an eccentric shaft according to an exemplary embodiment.

Referring to FIGS. 1 and 2, an internal combustion engine according to an exemplary embodiment of the present disclosure is shown generally at 10. The internal combustion engine 10 includes an engine block 12. The engine block 12 defines at least one cylinder bore 14 formed therein. A piston 16 is slidably supported within the cylinder bore 14. While FIG. 1 shows an internal combustion engine 10 with four-cylinder bores 14 and four pistons 16, it should be appreciated that the engine block 12 may be configured to include different multiples of cylinder bores 14. For example, the engine block 12 may be configured as a V-style engine having 2, 4, 6, 8, or 10-cylinder bores 14, or as an inline style engine having one or more cylinder bores 14. It should be appreciated that the engine block 12 may be configured in a manner other than the exemplary V-style or inline style engines noted above and may include any number of cylinder bores 14 other than the exemplary numbers described herein. The piston 16 slides back and forth reciprocally within the cylinder bore 14 throughout an engine cycle 18, including a piston compression stroke 20 having a compression stroke length 22A, 22B and a piston expansion stroke 24 having an expansion stroke length 26A, 26B.

A crankshaft 28 is rotatably supported by the engine block 12 and rotates about a crankshaft axis 30. The crankshaft 28 includes a driven gear 38 co-axially mounted thereon. An eccentric shaft 34 is rotatably supported by the engine block 12 and rotates about an eccentric shaft axis 36 that is parallel to and distal from the crank axis 30. The eccentric shaft 34 includes a driven gear 38 co-axially mounted thereon. A link rod 40 is rotatably supported on the crankshaft 28 and rotatable relative to the crankshaft 28 about a link rod axis 42 that is parallel to and distal from the crankshaft axis 30. A lower connecting rod 44 has a first end 46 that is rotatably connected to the link rod 40, and a second end 48 that is rotatably connected to the eccentric shaft 34. The lower connecting rod 44 is rotatable relative to the eccentric shaft 34 about a lower connecting rod axis 50 that is parallel to and distal from the eccentric shaft axis 36. An upper connecting rod 52 has a first end 54 rotatably connected to the link rod 40, and a second end 56 rotatably connected to the piston 16.

A speed change mechanism 58 is supported by the engine block 12 between and interconnecting the crankshaft 28 and the eccentric shaft 34. The speed change mechanism 58 is adapted to selectively change the rotational speed of the eccentric shaft 34 relative to the crankshaft 28 and changes the clearance volume within the cylinder bore 14 above the piston 16. The speed change mechanism 58 is referred to generally in FIG. 2 as the driven gear 38 and is motivated or rotated by the crankshaft 28 via a drive belt, chain, one or more gears or other such drive mechanism 60. The speed change mechanism 58 also includes any of a variety of devices that alter the rotational position of the eccentric shaft 34 relative to the crankshaft 28. The speed change mechanism 58 may also include drive elements 62 such as clutches, phasers, gearboxes, or the like, as will be discussed in further detail herein.

In the exemplary embodiment shown in FIG. 1, the speed change mechanism 58 includes an idler shaft 64 rotatable about an idler axis 66 that is parallel to and spaced from both the crankshaft axis 30 and the eccentric shaft axis 36. An electric motor 68 is connected to the idler shaft 64 and selectively rotates the idler shaft 64 about the idler axis 66. The electric motor 68 can selectively cause the rotational speed of the idler shaft 64, and consequently, the rotational speed of the eccentric shaft 34 to speed up or slow down relative to the rotational speed of the crankshaft 28.

A gearbox 70 is mounted co-axially on the idler shaft 64. A crank gear 72 is supported on the gearbox 70 co-axial to the idler shaft 64. An eccentric shaft gear 74 is mounted co-axially on the idler shaft 64 distal from the crank gear 72. The gearbox 70 is adapted to allow the rotational speed of the idler shaft 64 relative to the rotational speed of the crank gear 72 to change when the electric motor 68 acts on the idler shaft 64. It should be understood that the gearbox 70 may be any high ratio device adapted to interconnect the crank gear 72 and the idler shaft 64. For example, the gearbox could be a harmonic drive, a planetary gearset, or roller reducer. These examples are exemplary in nature and are not intended to limit the scope of this disclosure.

The link rod 40 is rotatably supported on the crankshaft 28 and rotatable relative to the crankshaft 28 about the link rod axis 42. The eccentric connection between the link rod 40 and the crankshaft 28 causes the link rod 40 to move as the crankshaft 28 rotates. The first end 46 of the lower connecting rod 44 is rotatably connected to the link rod 40, and the second end 48 is rotatably connected to the eccentric shaft 34. The lower connecting rod 44 is rotatable relative to the eccentric shaft 34 about the lower connecting rod axis 50. Due to the eccentric connection of the second end 48 of the lower connecting rod 48 and the eccentric shaft 34, rotation of the eccentric shaft 34 about the eccentric shaft axis 36 causes the lower connecting rod 44 to act upon the link rod 40 and affects the pattern or path of the link rod 40.

Figure 3:
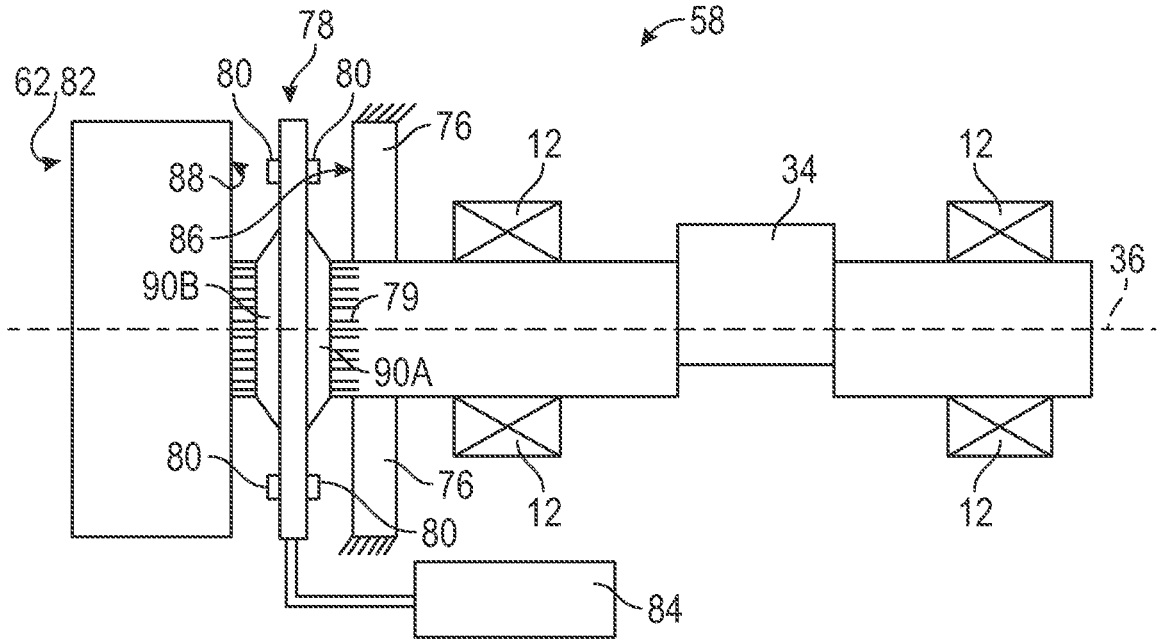
FIG. 3 is a schematic view of a speed change mechanism having a clutch and a phaser for an internal combustion engine according to an exemplary embodiment.

Referring now to FIG. 3, and with continuing reference to FIGS. 1 and 2, in an exemplary embodiment a speed change mechanism 58 for an eccentric shaft 34 is shown in detail. The eccentric shaft 34 is rotatably supported within a portion of the engine block 12 and passes through a stationary ground element 76. The stationary ground element 76 is fixed to the engine block 12 and remains stationary relative to the rotatable eccentric shaft 34. In one example, the stationary ground element 76 is formed as a part of the engine block 12 and reinforced to prevent flexing, twisting, or shear stresses.

A clutch plate 78 is disposed coaxially on a splined portion 79 of the eccentric shaft 34. The clutch plate 78 may be any of a variety of known clutch plate 78 types, including conical friction clutches, dog clutches, interference clutches or the like. In an example of an interference clutch, the clutch plate 78 includes a plurality of interference elements 80. The interference elements 80 may be dogs, or other such protrusions extending outward from the clutch plate 78 and adapted to align and engage with receiving features in adjacent clutch elements. The interference elements 80 may extend in an axial direction, a longitudinal direction, a radial direction, or the like with respect to the clutch plate 78 and the eccentric shaft 34. For example, the interference elements 80 of the clutch plate 78 are sized and shaped to precisely fit into a plurality of receiving features (not specifically shown) formed in the stationary ground element 76, or the drive element 62. Moreover, the interference elements 80 of the clutch plate 78 are spaced asymmetrically about the clutch plate 78 so that the interference elements 80 can only engage with and fit into the receiving features in a single predetermined orientation. Accordingly, by using a clutch plate 78 having interference dements 80, the rotational orientation or timing of the eccentric shaft 34 relative to the crankshaft 28 is preset.

A drive element 62 is also disposed coaxially on the eccentric shaft 34. However, unlike the clutch plate 78, the drive element 62 is rotatable relative to the eccentric shaft 34. The drive element 62 is rotatably supported on the eccentric shaft 34 by a bearing (not specifically shown). The bearing allows the drive element 62 to freely rotate about the eccentric shaft 34. In the example of FIG. 2, the drive dement 62 is a driven gear 38 or sprocket directly linked to the rotation of the crankshaft 28 by a chain or belt. However, in a variable compression ratio internal combustion engine 10, the driven gear 38 or sprocket is replaced by a phaser 82, as shown in FIG. 3. The phaser 82 is connected to or driven by the crankshaft 28 via a geartrain, chain drive, belt, chain, or the like. The phaser 82 can continuously and infinitely adjust or vary a compression ratio of the internal combustion engine 10 between a first predetermined compression ratio and a second predetermined compression ratio greater than the first predetermined compression ratio. The phaser 82 continuously and infinitely adjusts or varies the compression ratio of the engine 10 between a first predetermined compression ratio and a second predetermined compression ratio greater than the first predetermined compression ratio. The phaser 82 adjusts the compression ratio of the engine 10 by selectively altering a rotational position and/or speed of the eccentric shaft 34 relative to the crankshaft 28. The phaser 82, like the stationary ground element 76, includes a plurality of receiving features adapted to accept the interference elements 80 on the clutch plate 78. Accordingly, the rotational position or timing of the eccentric shaft 34 relative to the crankshaft 28 is preset or locked when the clutch plate 78 is engaged with the phaser 82.

A clutch actuator 84 is connected to the clutch plate 78 and manipulates a position of the clutch plate 78 along the splined portion 79 of the eccentric shaft 34. The clutch actuator 84 may be any of a wide variety of clutch actuator types without departing from the scope or intent of the present disclosure. For example, the clutch actuator 84 is a linear clutch actuator, a relay, a hydraulic or pneumatic piston, an electric clutch actuator, an electric motor 68, a valve, or the like. The clutch actuator 84 selectively moves the clutch plate 78 axially along the splined portion 79 of the eccentric shaft 34 between at least a first position 86 and a second position 88. As the clutch actuator 84 moves the clutch plate 78 towards either of the first or second positions 86, 88, one or more synchronizers 90 disposed on the clutch plate 78 are engaged. That is, as the clutch plate 78 approaches either of the first or second positions 86, 88, the synchronizers 90 come into physical contact with adjacent clutch devices. The synchronizers 90 then frictionally engage with adjacent clutch devices and are adapted to eliminate a difference in rotational speed between the clutch plate 78 and the adjacent clutch device such as the stationary ground element 76 or the phaser 82.

In the first position 86, a first of the synchronizers 90A frictionally engages the stationary ground element 76 to synchronize the rotational speed of the eccentric shaft 34 to the rotational speed of the stationary ground element 76. Moreover, the interference elements 80 of the clutch plate 78 engage with the stationary ground element 76 to rotationally lock the eccentric shaft 34 to the stationary ground element 76. That is, the interference elements 80 cause the eccentric shaft 34 to cease rotating. However, because the drive element 62 is freely rotatable about the eccentric shaft 34, the crankshaft 28 continues to rotate.

In the second position 88, the clutch plate 78 engages with and synchronizes rotational speeds with the drive element 62. More specifically, in the example of FIG. 3, a second of the synchronizers 90B frictionally engages the drive element 62 of the engine 10 to synchronize the rotational speed of the eccentric shaft 34 to the rotational speed of the drive element 62 of the engine 10. The interference elements 80 of the clutch plate 78 are also sized and shaped to precisely fit into a plurality of receiving features (not shown) formed in the drive element 62. At least one of the plurality of interference elements 80 engages with receiving features (not shown) formed in the drive element 62 to rotationally lock the eccentric shaft 34 to the drive element 62.

When the clutch plate 78 is engaged with and rotating with the phaser 82, the eccentric shaft 34 rotates at a second rotational speed greater than the first rotational speed. Moreover, the interference elements 80 lock the position of the eccentric shaft 34 to a known position of the drive element 62 or phaser 82, and therefore to a known position of the crankshaft 28 as well. In one example, when the clutch plate 78 is engaged with the drive element 62 or phaser 82, the rotational speed of the eccentric shaft 34 is one half of the rotational speed of the crankshaft 28. It should be appreciated that the while in the foregoing description of the second rotational speed, the second rotational speed of the eccentric shaft 34 one half of the crankshaft 28 speed, the second rotational speed of the eccentric shaft 34 is selected from any of a −8:1, −6:1, −4:1, −2:1, −1:1, −0.5:1, 0:1, 0.5:1, 1:1, 2:1, 4:1, 6:1, and 8:1 speed ratios relative to the speed of the crankshaft 28.

Thus, the eccentric shaft 34 may be engaged in a rotational direction that is opposite or counter to the rotational direction of the crankshaft 28, thereby providing a plurality of negative speed ratios as well as a plurality of positive and/or equal speed ratios. When the eccentric shaft 34 is driven at a non-zero rotational speed that is less than the rotational speed of the crankshaft 28 the piston 16 is driven in an extended stroke motion that causes one or more of the compression stroke length 22A, 22B, and the expansion stroke length 26A, 26B to be a first length. By contrast, when the eccentric shaft 34 is driven at the same speed as the crankshaft 28, the piston 16 has an equal stroke motion that causes one or more of the compression stroke length 22A, 22B, and the expansion stroke length 26A, 26B to be a second length such that the first length is smaller than the second length, as will be discussed in reference to FIG. 7 below. Moreover, when the eccentric shaft 34 is held stationary while the crankshaft 28 is rotated, the piston 16 is also driven in an equal stoke motion.

Figure 4:
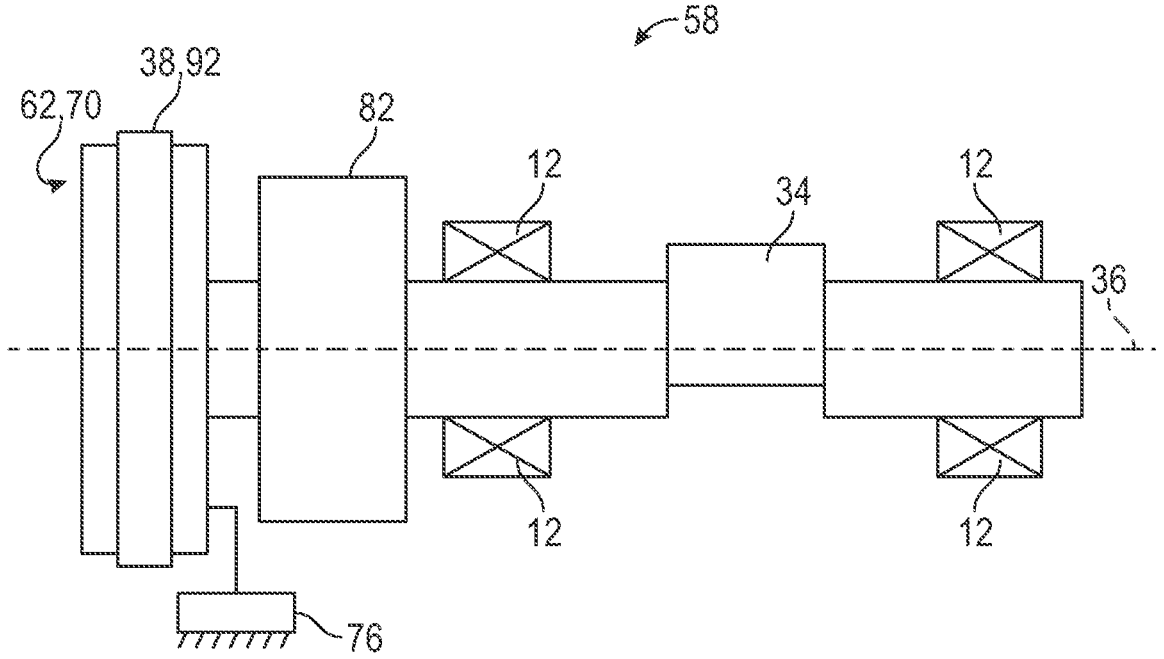
FIG. 4 is a schematic view of a speed change mechanism having a gearbox and a phaser for an internal combustion engine according to a second exemplary embodiment.

Referring to FIG. 4, and with continuing reference to FIGS. 1-3, another exemplary embodiment of an eccentric shaft 34 speed change mechanism 58 is shown in detail. As discussed above, the eccentric shaft 34 is rotatably supported in the engine block 12. Additionally, a phaser 82 is disposed directly on and rotates with the eccentric shaft 34.

A gearbox 70 is disposed on and coaxial with the eccentric shaft 34. The gearbox 70 rotates with the eccentric shaft 34. The gearbox 70 may be any of a variety of different types of gearbox 70 without departing from the scope or intent of the present disclosure. For example, the gearbox 70 utilizes a harmonic drive, a planetary gearset, a roller reducer, or the like. In the example of FIG. 4, the gearbox 70 includes a planetary gearset (not specifically shown). The planetary gearbox includes a sun gear (not shown) disposed on and affixed to the eccentric shaft 34. The sun gear rotatably engages a plurality of planetary gears (not shown), each of the planetary gears orbiting around a circumference of the sun gear. In one embodiment, one or more of the planetary gears is grounded or otherwise held stationary by a stationary ground element 76, similar to the stationary ground element 76 depicted in FIG. 3. A ring gear 92 is disposed around and rotatably engages with the planetary gears. The rind gear 92 operates as the driven gear 38. That is, the ring gear 92 is interconnected with and rotatably driven by the crankshaft 28 by one or more of a drive belt, a one or more crank gears (not specifically shown), a chain or other such drive mechanism 60, as depicted generally in FIGS. 1 and 2.

The gearbox 70 of the exemplary embodiment shown in FIG. 4 includes gearing that provides at least two different gear ratios. The at least two different gear ratios provide at least two ratios of the rotational speed of the eccentric shaft 34 relative to the crankshaft 28. The phaser 82 selectively alters a rotational position of the eccentric shaft 34 relative to the crankshaft 28 to adjust a compression ratio of the engine 10. More specifically, the gearbox 70 offers a first gear ratio that drives the eccentric shaft 34 at a one half of the rotational speed of the crankshaft 28, and a second gear ratio that drives the eccentric shaft 34 at the same rotational speed as the crankshaft 28. It should be appreciated that the while in the foregoing description, the gearbox 70 provides ratios that drive the eccentric shaft 34 at either one half of or at the same rotational speed as the crankshaft 28, the gearbox 70 may drive the eccentric shaft 34 at other rotational speeds relative to the crankshaft 28 without departing from the scope or intent of the present disclosure. For example, the ratio of the rotational speed of the eccentric shaft 34 to the rotational speed of the crankshaft 28 may be selected from any of a −8:1, −6:1, −4:1, −2:1, −0.5:1, 0:1, 0.5:1, 1:1, 2:1, 4:1, 6:1, and 8:1 speed ratios.

Thus, the eccentric shaft 34 may be engaged in a rotational direction that is opposite or counter to the rotational direction of the crankshaft 28, thereby providing a plurality of negative speed ratios as well as a plurality of positive and/or equal speed ratios. When the eccentric shaft 34 is driven at a non-zero rotational speed that is less than the rotational speed of the crankshaft 28, the piston 16 is driven in an extended stroke motion that causes one or more of the compression stroke length 22A, 22B, and the expansion stroke length 26A, 26B to be a first length. By contrast, when the eccentric shaft 34 is driven at the same speed as the crankshaft 28, the piston 16 has an equal stroke motion that causes one or more of the compression stroke length 22A, 22B, and the expansion stroke length 26A, 26B to be a second length such that the first length is smaller than the second length, as will be discussed in reference to FIG. 7 below. Moreover, when the eccentric shaft 34 is held stationary while the crankshaft 28 is rotated, the piston 16 is also driven in an equal stoke motion.

Figure 5:
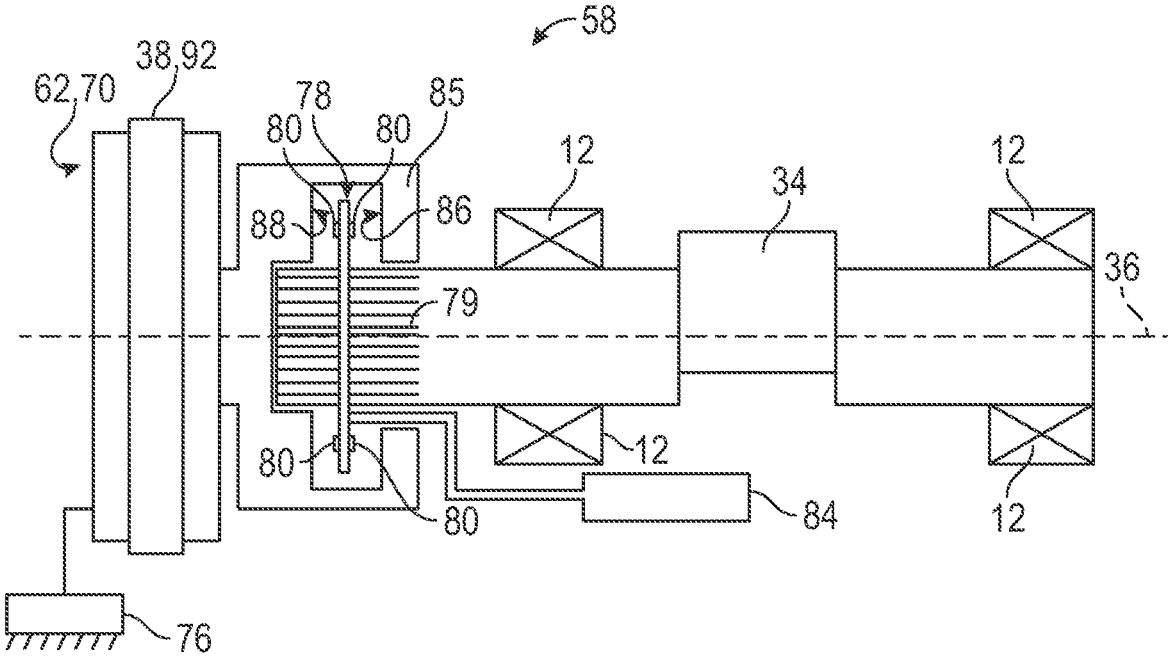
FIG. 5 is a schematic view of a speed change mechanism having a gearbox, and a clutch for an internal combustion engine according to a third exemplary embodiment.

Yet another exemplary embodiment is shown in FIG. 5, and with continuing reference to FIGS. 1-4. As discussed previously and shown in FIGS. 3 and 4, the eccentric shaft 34 is rotatably supported in the engine block 12.

The eccentric shaft speed change mechanism 58 shown in FIG. 5 includes a gearbox 70 that is mounted separate from, but coaxial with the eccentric shaft 34. The gearbox 70 is one of a variety of different types of gearbox 70 without departing from the scope or intent of the present disclosure. For example, the gearbox 70 utilizes a harmonic drive, a planetary gearset, a roller reducer, or the like. In the example of FIG. 5, the gearbox 70 includes a planetary gearset (not specifically shown). The planetary gearbox includes a sun gear (not shown) disposed on and affixed to the clutch housing 85. The sun gear rotatably engages a plurality of planetary gears (not shown), each of the planetary gears orbiting around a circumference of the sun gear. In one embodiment, one or more of the planetary gears is grounded or otherwise held stationary by a stationary ground element 76, similar to the stationary ground element 76 depicted in FIGS. 3 and 4. A ring gear 92 is disposed around and rotatably engages with the planetary gears. The ring gear 92 operates as the driven gear 38. That is, the ring gear 92 is interconnected with and rotatably driven by the crankshaft 28 by one or more of a drive belt, a one or more crank gears (not specifically shown), a chain or other such drive mechanism 60 as depicted generally in FIGS. 1 and 2. The gearbox 70 of the exemplary embodiment shown in FIG. 5 includes gearing that provides at least two different gear ratios. The at least two different gear ratios provide at least two ratios of the rotational speed of the eccentric shaft 34 relative to the crankshaft 28.

A clutch plate 78 is disposed coaxially on a splined portion 79 of the eccentric shaft 34. The clutch plate 78 is any of a variety of known clutch plate 78 types, including conical friction clutches, dog clutches, interference clutches and the like. In an example of an interference clutch, the clutch plate 78 includes a plurality of interference dements 80. The interference dements 80 may be dogs, or other such protrusions adapted to align and engage with receiving features in adjacent clutch elements. The interference elements 80 may extend in an axial direction, a longitudinal direction, a radial direction, or the like with respect to the clutch plate 78 and the eccentric shaft 34. For example, the interference dements 80 of the clutch plate 78 are sized and shaped to precisely fit into a plurality of receiving features (not specifically shown) formed in a clutch housing 85. Moreover, the interference elements 80 of the clutch plate 78 are spaced asymmetrically about the clutch plate 78 so that the interference elements 80 can only engage with and fit into the receiving features in a single predetermined orientation in each of the first and second positions 86, 88. Accordingly, by using a clutch plate 78 having interference elements 80, the rotational orientation or timing of the eccentric shaft 34 relative to the crankshaft 28 is preset.

While not shown specifically in FIG. 5, in some embodiments one or more synchronizers 90 are disposed on the clutch plate 78. The synchronizers 90 engage frictionally with adjacent clutch devices, such as the clutch housing 85, to eliminate a difference in rotational speed between the clutch plate 78 and an adjacent clutch device.

The gearbox 70 is coupled to the clutch housing 85. The clutch housing 85 and the gearbox 70 are rotatably mounted to the engine block 12, or in some cases, a separate transmission housing (not shown). Both of the clutch housing and the gearbox 70 are aligned with and coaxial with the eccentric shaft 34. The gearbox 70 is rotatably coupled to the crankshaft 28 and is driven by the crankshaft 28 via a ring gear 92 coupled to the drive mechanism 60. That is, the ring gear 92 operates as the driven gear 38 and is interconnected with and rotatably driven by the crankshaft 28 via one or more of a drive belt, one or more crank gears (not specifically shown), a chain or other such drive mechanism 60, as depicted generally in FIGS. 1 and 2.

Rotational motion of the gearbox 70 is selectively coupled to the eccentric shaft 34 by the clutch plate 78. The clutch plate 78 is disposed coaxially on the eccentric shaft 34, and within the clutch housing 85. A clutch actuator 84 is connected to the clutch plate 78 and manipulates an axial position of the clutch plate 78 along the splined portion 79 of the eccentric shaft 34. The clutch actuator 84 is one of a wide variety of clutch actuator types without departing from the scope or intent of the present disclosure. For example, the clutch actuator 84 is a linear clutch actuator, a relay, a hydraulic or pneumatic piston, an electric clutch actuator, a motor, a valve, or the like. The clutch actuator 84 selectively moves the clutch plate 78 axially along the splined portion 79 of the eccentric shaft 34 between at least a first position 86 and a second position 88.

The clutch plate 78 is equipped with one or more interference elements 80. The interference elements 80 may extend in an axial direction, a longitudinal direction, a radial direction, or the like with respect to the clutch plate 78 and the eccentric shaft 34. As the clutch actuator 84 moves the clutch plate 78 towards either of the first or second positions 86, 88, the interference elements 80 come into physical contact with the clutch housing 85 and frictionally engage with the clutch housing 85 in specific predetermined rotational orientations, thereby locking the clutch plate 78 and the eccentric shaft 34 to one or more predetermined rotational orientations relative to the crankshaft 28, and eliminating a difference in rotational speed between the clutch housing 85 and the clutch plate 78.

Furthermore, in the first position 86, the interference elements 80 cause the clutch plate 78 to engage with and lock rotational positions with the clutch housing 85 in a first rotational orientation. In the first rotational orientation, rotational movement of the crankshaft 28 is translated into rotational movement of the eccentric shaft 34 while the eccentric shaft 34 is held at a first predetermined rotational orientation relative to the crankshaft 28. Similarly, in the second position 88, the interference elements 80 cause the clutch plate 78 to engage with and lock rotational positions with the clutch housing 85 in a second rotational orientation. In the second rotational orientation, rotational movement of the crankshaft 28 is translated into rotational movement of the eccentric shaft 34 while the eccentric shaft 34 is locked in a second predetermined rotational orientation relative to the crankshaft 28.

In either of the first or second positions 86, 88, the gearbox 70 may engage one or more gear ratios to after a rotational speed of the eccentric shaft 34 relative to the crankshaft 28. In one exemplary embodiment, when a first gear ratio is engaged in the gearbox 70, the gearbox 70 causes the eccentric shaft 34 to rotate at a first rotational speed that is one half of the rotational speed of the crankshaft 28. In a second exemplary embodiment, the gearbox engages a second gear ratio that causes the eccentric shaft 34 to rotate at a second rotational speed that is equal to the rotational speed of the crankshaft 28.

It should be appreciated that the while in the foregoing embodiments, the gearbox 70 provides ratios that drive the eccentric shaft 34 at either one half of or at the same rotational speed as the crankshaft 28, the gearbox 70 may drive the eccentric shaft 34 at other rotational speeds relative to the crankshaft 28 without departing from the scope or intent of the present disclosure. For example, the ratio of the rotational speed of the eccentric shaft 34 to the rotational speed of the crankshaft 28 may be selected from any of a −−8:1, −6:1, −4:1, −2:1, −1:1, −0.5:1, 0:1, 0.5:1, 1:1, 2:1, 4:1, 6:1, and 8:1 speed ratios.

Thus, the eccentric shaft 34 may be engaged in a rotational direction that is opposite or counter to the rotational direction of the crankshaft 28, thereby providing a plurality of negative speed ratios as well as a plurality of positive and/or equal speed ratios. When the eccentric shaft 34 is driven at a non-zero rotational speed that is less than the rotational speed of the crankshaft 28, the piston 16 is driven in an extended stroke motion that causes one or more of the compression stroke length 22A, 22B, and the expansion stroke length 26A, 26B to be a first length. By contrast, when the eccentric shaft 34 is driven at the same speed as the crankshaft 28, the piston 16 has an equal stroke motion that causes one or more of the compression stroke length 22A, 22B, and the expansion stroke length 26A, 26B to be a second length such that the first length is smaller than the second length, as will be discussed in reference to FIG. 7 below. Moreover, when the eccentric shaft 34 is held stationary while the crankshaft 28 is rotated, the piston 16 is also driven in an equal stoke motion.

Figure 6:
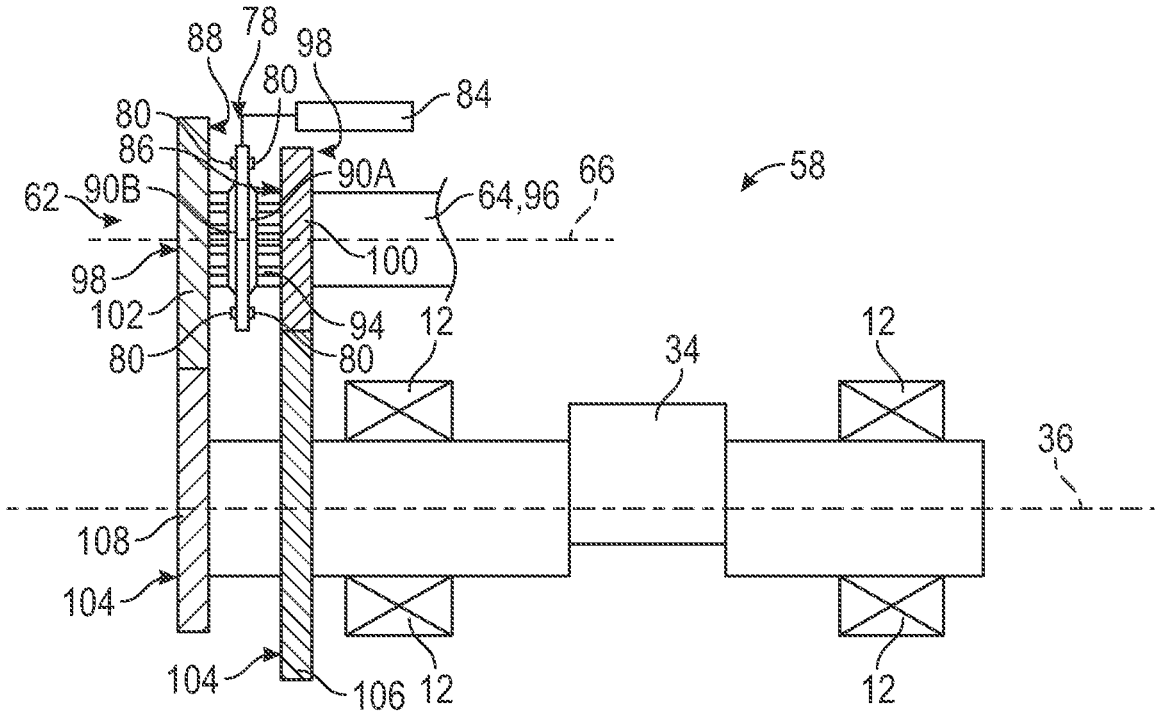
FIG. 6 is a schematic view of a speed change mechanism having an idler shaft and a clutch for an internal combustion engine according to a second exemplary embodiment.

Yet another exemplary embodiment of an eccentric shaft 34 speed change mechanism 58 of the present disclosure is shown in FIG. 6, and with continuing reference to FIGS. 1-5. As discussed above and shown in FIGS. 3-5 the eccentric shaft 34 is rotatably supported in the engine block 12.

A clutch plate 78 is disposed on a second splined portion 94 of an input shaft 96. The input shaft 96 provides rotational motion to the eccentric shaft 34 via one or more drive mechanisms 60. The input shaft 96 may be the crankshaft 28, an idler shaft 64, or the like. In an example utilizing an idler shaft 64, the idler shaft 64 has an idler axis 66 that is parallel to and distal from both the crank axis 30 and the eccentric shaft axis 36. The clutch plate 78 is one of a variety of known clutch plate 78 types, including conical friction clutches, dog clutches, interference clutches or the like. In an example of an interference clutch, the clutch plate 78 includes one or more interference elements 80 extending outward from the clutch plate 78. The interference elements 80 may be dogs, or other such protrusions adapted to align and engage with receiving features in adjacent clutch elements.

The interference elements 80 may extend in an axial direction, a longitudinal direction, a radial direction, or the like with respect to the clutch plate 78 and the input shaft 96. For example, the interference elements 80 of the clutch plate 78 are sized and shaped to precisely fit into one or more receiving features (not specifically shown) formed in a plurality of input shaft gears 98, such as a first input shaft gear 100, or a second input shaft gear 102. Moreover, the interference elements 80 of the clutch plate 78 are spaced asymmetrically about the clutch plate 78 so that the interference elements 80 can only engage with and fit into the receiving features in a single predetermined orientation with either of the first or second input shaft gears 100, 102. Accordingly, by using a clutch plate 78 having interference elements 80, the rotational orientation or timing of the eccentric shaft 34 relative to the crankshaft 28 is locked into predetermined known positions.

A clutch actuator 84 is connected to the clutch plate 78 and manipulates a position of the clutch plate 78 along the second splined portion 94 of the input shaft 96. The clutch actuator 84 is any of a variety of clutch actuator 84 types without departing from the scope or intent of the present disclosure. For example, the clutch actuator 84 is a linear clutch actuator, a relay, a hydraulic or pneumatic piston, an electric clutch actuator, a motor, a valve, or the like. The clutch actuator 84 selectively moves the clutch plate 78 axially along the second splined portion 94 of the input shaft 96 between at least a first position 86 and a second position 88. As the clutch actuator 84 moves the clutch plate 78 towards either of the first or second positions 86, 88, one or more synchronizers 90 disposed on the clutch plate 78 are frictionally engaged. That is, the synchronizers 90 engage frictionally with adjacent clutch devices to eliminate a difference in rotational speed between the clutch plate 78 and an adjacent clutch device such as the first input shaft gear 100 or the second input shaft gear 102. More specifically, a first of the synchronizers 90A is selectively engageable with the first input shaft gear 100 and a second of the synchronizers 90B is selectively engageable with the second input shaft gear 102.

Each of the plurality of input shaft gears 98 is permanently enmeshed with and rotates with one of a plurality of eccentric shaft gears 104 to provide a plurality of enmeshed input shaft gear and eccentric gear pairs. Each of the input shaft gear and eccentric shaft gear pairs is adapted to transfer rotational motion from the input shaft 96 to the eccentric shaft 34 at a predetermined gear ratio. In particular, the first input shaft gear 100 is enmeshed with a first eccentric shaft gear 106 to form a first input shaft gear and eccentric gear pair, and the second input shaft gear 102 is enmeshed with a second eccentric shaft gear 108 to form a second input shaft gear and eccentric gear pair. When the clutch actuator 84 moves the clutch plate 78 to the first position 86, the clutch plate 78 engages with the first input shaft gear 100 and causes a first gear ratio to be engaged. In one example, when the first gear ratio is engaged, the eccentric shaft 34 rotates at one half of the rotational speed of the crankshaft 28. Similarly, when the clutch actuator 84 moves the clutch plate 78 to the second position 86, the clutch plate 78 engages with the second input shaft gear 102 causing a second gear ratio to be engaged. In an example, the second gear ratio causes the eccentric shaft 34 to rotate at the same speed as the crankshaft 28.

It should be appreciated that the while in the foregoing description, the gearbox 70 provides ratios that drive the eccentric shaft 34 at either one half of or at the same rotational speed as the crankshaft 28, the gearbox 70 may drive the eccentric shaft 34 at other rotational speeds relative to the crankshaft 28 without departing from the scope or intent of the present disclosure. For example, the ratio of the rotational speed of the eccentric shaft 34 to the rotational speed of the crankshaft 28 may be selected from any of a −8:1, −6:1, −4:1, −2:1, −1:1, −0.5:1, 0:1, 0.5:1, 1:1, 2:1, 4:1, 6:1, and 8:1 speed ratios.

Thus, the eccentric shaft 34 may be engaged in a rotational direction that is opposite or counter to the rotational direction of the crankshaft 28, thereby providing a plurality of negative speed ratios as well as a plurality of positive and/or equal speed ratios. When the eccentric shaft 34 is driven at a non-zero rotational speed that is less than the rotational speed of the crankshaft 28, the piston 16 is driven in an extended stroke motion that causes one or more of the compression stroke length 22A, 22B, and the expansion stroke length 26A, 26B to be a first length. By contrast, when the eccentric shaft 34 is driven at the same speed as the crankshaft 28, the piston 16 has an equal stroke motion that causes one or more of the compression stroke length 22A, 22B, and the expansion stroke length 26A, 26B to be a second length such that the first length is smaller than the second length, as will be discussed in reference to FIG. 7 below. Moreover, when the eccentric shaft 34 is held stationary while the crankshaft 28 is rotated, the piston 16 is also driven in an equal stoke motion.

Figure 7:
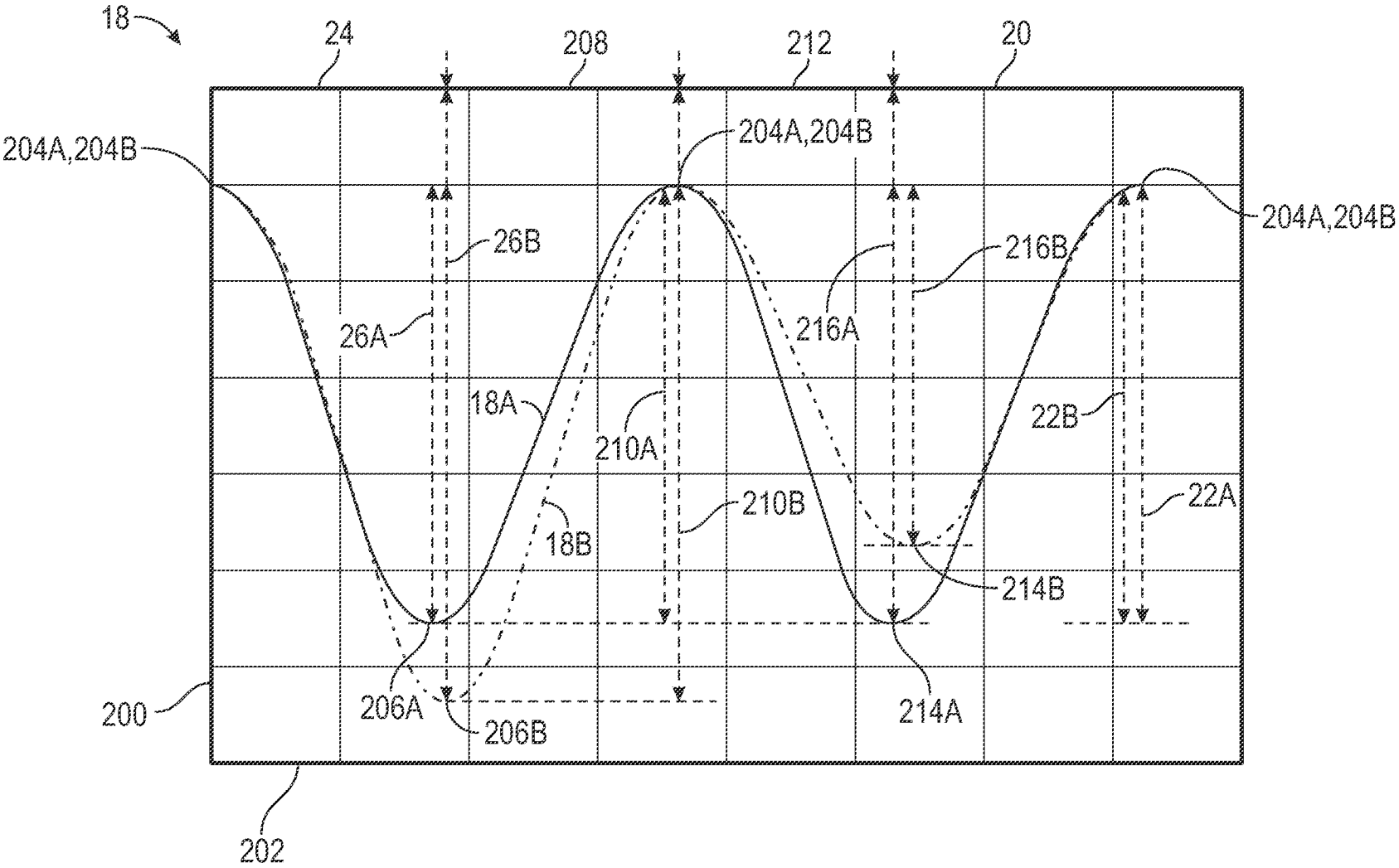
FIG. 7 is a graphical representation of an engine cycle for an internal combustion engine according to an exemplary embodiment.

Referring now to FIGS. 1, 2, and 7, and with continuing reference to FIGS. 3-6, the motion of the link rod 40 due to the rotation of the crankshaft 28 and input from rotation of the eccentric shaft 34 controls the reciprocating motion of the piston 16 within the cylinder bore 14. Referring to FIG. 7 in particular, two different engine cycles 18A and 18B of an internal combustion engine 10 are graphically represented. A first engine cycle 18A depicts an engine cycle 18 in which the eccentric shaft 34 and the crankshaft 28 are rotating at the same rate as one another in a 1:1 speed ratio. By contrast, the second engine cycle 18B depicts an engine cycle 18 in which the eccentric shaft 34 is rotating at one half of the rotational speed of the crankshaft 28. For ease of understanding, FIG. 7 has been numbered according to which of the first or second engine cycles 18A, 18B is being depicted. That is, each of the elements of the first engine cycle 18A includes a suffix "A", while each of the elements of the second engine cycle 18B includes a suffix "B".

The position of the piston 16 is generally shown along a vertical axis 200, and the stage or time duration of the cycle is generally shown along a horizontal axis 202. A top dead center position 204A, 204B is the position of the piston 16 at the end of a compression stroke 20 and at a beginning of an expansion stroke 24. FIG. 7 is a graphical representation of a complete cycle of the piston 16. The top dead center position 204A, 204B of the piston 16 at the end of the compression stroke 20 and the beginning of the expansion stroke 24 occurs at both the far left and far right ends of the engine cycle 18.

Beginning at the top dead center position 204A, 204B of the piston 16 at the far-left side of the engine cycle 18, at the end of the piston compression stroke 20, the fuel air mixture is ignited and the piston 16 begins moving downward within the cylinder bore 14 and begins the piston expansion stroke 24. During the piston expansion stroke 24 the ignited fuel air mixture rapidly expands and forces the piston 16 downward within the cylinder bore 14. The end of the piston expansion stroke 24 occurs at point 206A, 206B. The expansion stroke length 26A, 26B is the distance the piston 16 travels within the cylinder bore 14 during the piston expansion stroke 24. Near the end 206A, 206B of the piston expansion stroke 24, an exhaust valve is opened in the cylinder head and the piston 16 begins moving upward in the cylinder bore 14 to force the combusted gases to exhaust through the exhaust valve. This begins the exhaust stroke 208. The end of the exhaust stroke 208 occurs at the top dead center position 204A, 204B of the piston 16, shown at the top center of the engine cycle 18. The distance the piston 16 travels within the cylinder bore 16 during the exhaust stroke 208 is the exhaust stroke length 210A, 210B.

The top dead center position 204A, 204B at the end of the exhaust stroke 208 also represents the beginning of an intake stroke 212. During the intake stroke 212, an intake valve in the cylinder head is opened to allow fuel and combustion air to enter the cylinder bore 14. The end of the intake stroke 212 occurs at point 214A, 214B. During the intake stroke 212, the distance the piston 16 travels between the top dead center position 204A, 204B and the end 214A, 214B of the intake stoke 212 is an intake stroke length 216A, 216B. At the end 214A, 214B of the intake stroke 212, the intake valve closes and the piston 16 changes direction and begins moving upward within the cylinder bore 14, beginning the piston compression stroke 20. The piston compression stroke 20 ends at point 204A, 204B. The distance the piston 16 travels during the compression stroke 20 is the compression stroke length 22A, 22B.

Referring once more to FIGS. 1-4, and with continuing reference to FIGS. 5-7, the phaser 82 is an electric motor 68, a hydraulic or pneumatic device, a valve, a solenoid, or any of a variety of similar devices. In an example in which the phaser 82 is an electric motor 68, the phaser 82 operates in a steady state condition to maintain the rotational speed of the eccentric shaft 34 relative to the rotational speed of the crankshaft 28 as constant and the position of the second end 48 of the lower connecting rod 44 is always at the same position relative to any given point in the engine cycle 18. However, the electric motor 68 of the speed change mechanism 58 can be used to temporarily speed up or slow down the rotational speed of the eccentric shaft 34 relative to the rotational speed of the crank shaft 28. Afterward, electric motor 68 is turned off, the rotational speed of the eccentric shaft 34 relative to the rotational speed of the crankshaft 28 is once again constant. However, after temporarily varying the rotation speed of the eccentric shaft 34 relative to the rotational speed of the crankshaft 28, the position of the second end 48 of the lower connecting rod 44 is rotationally shifted, or "phased". This means that the rotational position of the second end 48 of the connecting rod 44 about the eccentric shaft axis 36 relative to the position of the crankshaft 28 at any given point during the engine cycle 18 after being phased is different than the rotational position of the second end 48 of the connecting rod 44 about the eccentric shaft axis 36 relative to the position of the crankshaft 28 at that same point during the engine cycle 18 prior to being phased.

The compression stroke length 216 is less than the expansion stroke length 26A, 26B. By changing the position of the lower connecting rod 44, the movement or path that the link rod 40 follows is altered, which changes the compression stroke length 216, but more importantly, changes the clearance volume within the cylinder bore 14 above the piston 16. By changing the compression stroke length 216 of the piston 16, the compression ratio of the internal combustion engine is changed. By changing the clearance volume, the compression ratio of the internal combustion engine 10 that occurs during the compression stroke 20 is reduced. A small change in the clearance volume results in a large change in compression ratio. Accordingly, by controlling the position of the lower connecting rod 44, the compression ratio of the internal combustion engine 10 may be controlled and changed between a high compression ratio during certain engine operating conditions, and a low compression ratio during other engine operating conditions. The internal combustion engine 10 described herein provides a variable compression ratio engine that enables the use of an Atkinson cycle, in which the compression stroke length 216 is less than the expansion stroke length 26A, 26B, in both high load and high engine speed conditions and low load and low engine speed conditions, to achieve the fuel economy benefits that may be realized from the Atkinson cycle for all operating conditions of the internal combustion engine 10.

The description of the present disclosure is merely exemplary in nature and variations that do not depart from the gist of the present disclosure are intended to be within the scope of the present disclosure. Such variations are not to be regarded as a departure from the spirit and scope of the present disclosure.

What is claimed is:

1. An internal combustion engine comprising:

an engine block defining a cylinder bore;

a piston slidably supported within the cylinder bore, wherein the piston slides reciprocally within the cylinder bore throughout an engine cycle, including a piston compression stroke having a compression stroke length and a piston expansion stroke having an expansion stroke length;

a crankshaft rotatably supported by the engine block and rotatable about a crank axis;

an eccentric shaft rotatably supported within the engine and rotatable about an eccentric shaft axis, wherein the eccentric shaft axis is parallel to and distal from the crank axis;

a speed change mechanism interlinking movement of the eccentric shaft and the crankshaft, wherein the speed change mechanism selectively varies a ratio of a rotational speed of the eccentric shaft relative to a rotational speed of the crankshaft from 1:1 to one of: −8:1, −6:1, −4:1, −2:1, −1:1, −0.5:1, 0:1, 0.5:1, 1:1, 2:1, 4:1, 6:1, and 8:1, thereby causing the eccentric shaft to rotate at a speed different from the crankshaft and varying a rotational position of the eccentric shaft relative to the crankshaft, wherein the speed change mechanism includes an interference clutch having:

a clutch actuator;

a clutch plate disposed coaxially on the eccentric shaft between a stationary ground element and a drive element of the engine, the clutch actuator adapted to move the clutch plate axially along the eccentric shaft between a first position and a second position;

a first synchronizer mounted onto the clutch plate, facing the stationary ground element;

a second synchronizer mounted onto the clutch plate, facing the drive element of the engine; and one or more interference elements extending outward from the clutch plate;

wherein the clutch actuator selectively moves the clutch plate between the first position and the second position, wherein the clutch actuator moves the clutch plate into the first position, wherein the clutch actuator moves the clutch plate toward the stationary ground element, the first synchronizer frictionally engages the stationary ground element to synchronize the rotational speed of the eccentric shaft to the rotational speed of the stationary ground element, and at least one of the interference elements engages the stationary ground element to rotationally lock the eccentric shaft to the stationary ground element, and wherein the clutch actuator moves the clutch plate to the second position, wherein the clutch actuator moves the clutch plate toward the drive element of the engine, the second synchronizer frictionally engages the drive element of the engine to synchronize the rotational speed of the eccentric shaft to the rotational speed of the drive element of the engine, and at least one of the interference elements engages the drive element to rotationally lock the eccentric shaft to the drive element, wherein the rotational speed of the drive element of the engine is greater than the rotational speed of the stationary ground element.

2. The internal combustion engine of claim 1 wherein the rotational speed of the stationary ground element is zero, and the rotational speed of the drive element of the engine is one half the rotational speed of the crankshaft.

3. The internal combustion engine of claim 1 wherein the drive element further comprises:

a phaser that selectively adjusts a rotational position of the eccentric shaft relative to the crankshaft and infinitely adjusts a compression ratio of the internal combustion engine between a first predetermined compression ratio and a second predetermined compression ratio greater than the first predetermined compression ratio.

4. The internal combustion engine of claim 1 wherein the drive element further comprises:

a gearbox; and a phaser, wherein the gearbox is disposed on and coaxial with the eccentric shaft and selectively rotates the eccentric shaft at a rotational speed that is one of: one half of the rotational speed of the crankshaft, and the same as the rotational speed of the crankshaft, and wherein the phaser is disposed on and coaxial with the eccentric shaft, and selectively alters a rotational position of the eccentric shaft relative to a rotational position of the crankshaft to adjust a compression ratio of the internal combustion engine.

5. The internal combustion engine of claim 4 wherein the phaser adjusts a stroke length and a top dead center position of the piston inside the cylinder bore between at least a first length with a first top dead center position and a second length with a second top dead center position, the first length is smaller than the second length, the first top dead center position is between the second top dead center position and the crankshaft, the first length defines a first predetermined compression ratio and the second length defines a second predetermined compression ratio greater than the first predetermined compression ratio, and wherein the gearbox is one of a harmonic drive, a planetary gearset, and a roller reducer.

6. The internal combustion engine of claim 1 wherein the drive element further includes:

a gearbox rotatably supported by the engine block and coaxial with the eccentric shaft; and a clutch housing supported coaxially on the eccentric shaft;

a clutch plate rotatably engaged with the eccentric shaft and moveable axially along the eccentric shaft within the clutch housing, the clutch plate including at least one interference element extending outward from the clutch plate; and a clutch actuator adapted to move the clutch plate axially along the eccentric shaft within the clutch housing, wherein the clutch actuator selectively moves the clutch plate between a first position and a second position, wherein in the first position the at least one interference element of the clutch plate engages the clutch housing in a first rotational orientation and eliminates a difference in rotational speed between the eccentric shaft and the clutch housing, wherein in the second position the at least one interference element of the clutch plate engages with the clutch housing in a second rotational orientation different than the first rotational orientation and eliminates a difference in rotational speed between the eccentric shaft and the clutch housing, and wherein the gearbox selectively rotates the eccentric shaft at a rotational speed that is one of: one half of the rotational speed of the crankshaft, and the same as the rotational speed of the crankshaft.

7. The internal combustion engine of claim 6 wherein a phaser adjusts a stroke length and a top dead center position of the piston inside the cylinder bore between at least a first length with a first top dead center position and a second length with a second top dead center position, the first length is smaller than the second length, the first top dead center position is between the second top dead center position and the crankshaft, the first length defines a first predetermined compression ratio and the second length defines a second predetermined compression ratio greater than the first predetermined compression ratio, and wherein the gearbox is one of a harmonic drive, a planetary gearset, and a roller reducer.

8. The internal combustion engine of claim 1 wherein the drive element further includes:

an input shaft rotatably supported by the engine block and parallel to the eccentric shaft;

a plurality of input shaft gears rotatably disposed on the input shaft;

a clutch plate disposed coaxially on the input shaft axially between the plurality of input shaft gears, the clutch plate including one or more interference elements extending outward from the clutch plate;

a first synchronizer disposed on the clutch plate and facing a first of the plurality of input shaft gears, and a second synchronizer disposed on the clutch plate opposite the first synchronizer and facing a second of the plurality of input shaft gears;

a plurality of eccentric shaft gears disposed on the eccentric shaft, each of the plurality of input shaft gears enmeshed with one of the plurality of eccentric shaft gears, defining a plurality of enmeshed input shaft gear and eccentric gear pairs, each enmeshed input shaft gear and eccentric shaft gear pair adapted to transfer rotational motion from the input shaft to the eccentric shaft at a predetermined gear ratio; and a clutch actuator adapted to selectively move the clutch plate axially along the input shaft between a first position and a second position, wherein in the first position the first synchronizer frictionally engages the first input shaft gear to synchronize a rotational speed of the input shaft to a rotational speed of the first input shaft gear, and at least one of the interference elements engages the first input shaft gear to rotationally lock the input shaft to the first input shaft gear, and wherein the clutch actuator moves the clutch plate to the second position, wherein the clutch actuator moves the clutch plate towards the second input shaft gear and the second synchronizer frictionally engages the second input shaft gear to synchronize a rotational speed of the input shaft to a rotational speed of the second input shaft gear, and at least one of the interference elements engages the second input shaft gear to rotationally lock the input shaft to the second input shaft gear, wherein rotational motion of the input shaft is transferred through the one of the plurality of input shaft gears to the enmeshed one of the plurality of eccentric shaft gears, and to the eccentric shaft, wherein a first of the plurality of enmeshed input shaft gear and eccentric shaft gear pairs rotates the eccentric shaft at one half of the rotational speed of the crankshaft, and a second of the plurality enmeshed input shaft gear and eccentric gear pairs rotates the eccentric shaft at the same rotational speed as the crankshaft.

9. An internal combustion engine comprising:

an engine block defining a cylinder bore;

a piston slidably supported within the cylinder bore, wherein the piston slides reciprocally within the cylinder bore throughout an engine cycle, including a piston compression stroke having a compression stroke length and a piston expansion stroke having an expansion stroke length;

a crankshaft rotatably supported by the engine block and rotatable about a crank axis;

an eccentric shaft rotatably supported within the engine and rotatable about an eccentric shaft axis, wherein the eccentric shaft axis is parallel to and distal from the crank axis;

a speed change mechanism interlinking movement of the eccentric shaft and the crankshaft, and including a clutch rotatably engaged with the eccentric shaft; and a drive element rotatably engaged with the crankshaft, wherein the drive element includes:

a gearbox rotatably supported by the engine block and coaxial with the eccentric shaft; and a clutch housing supported coaxially on the eccentric shaft;

a clutch plate rotatably engaged with the eccentric shaft and moveable axially along the eccentric shaft within the clutch housing, the clutch plate including at least one interference element extending outward from the clutch plate; and a clutch actuator adapted to move the clutch plate axially along the eccentric shaft within the clutch housing, wherein the clutch actuator selectively moves the clutch plate between a first position and a second position, wherein in the first position the at least one interference element of the clutch plate engages the clutch housing in a first rotational orientation and eliminates a difference in rotational speed between the eccentric shaft and the clutch housing, wherein in the second position the at least one interference element of the clutch plate engages with the clutch housing in a second rotational orientation different than the first rotational orientation and eliminates a difference in rotational speed between the eccentric shaft and the clutch housing, and wherein the gearbox selectively rotates the eccentric shaft at a rotational speed that is one of: one half of the rotational speed of the crankshaft, and the same as the rotational speed of the crankshaft, and wherein the clutch selectively rotatably engages the eccentric shaft and the drive element to transfer rotation of the crankshaft to the eccentric shaft, and the drive element selectively varies a ratio of a rotational speed of the eccentric shaft relative to a rotational speed of the crankshaft from 1:1 to one of: −8:1, −6:1, −4:1, −2:1, −1:1, −0.5:1, 0:1, 0.5:1, 1:1, 2:1, 4:1, 6:1, and 8:1, thereby causing the eccentric shaft to rotate at a speed different from the crankshaft and varying a rotational position of the eccentric shaft relative to the crankshaft.

10. The internal combustion engine of claim 9 wherein the clutch is an interference clutch including:

a clutch actuator;

a clutch plate disposed coaxially on the eccentric shaft between a stationary ground element and a drive element of the engine, the clutch actuator adapted to move the clutch plate axially along the eccentric shaft between a first position and a second position;

a first synchronizer mounted onto the clutch plate, facing the stationary ground element, and a second synchronizer mounted onto the clutch plate, facing the drive element of the engine; and one or more interference elements extending outward from the clutch plate;

wherein the clutch actuator selectively moves the clutch plate between the first position and the second position, wherein the clutch actuator moves the clutch plate into the first position, wherein the clutch actuator moves the clutch plate toward the stationary ground element, the first synchronizer frictionally engages the stationary ground element to synchronize the rotational speed of the eccentric shaft to the rotational speed of the stationary ground element, and at least one of the interference elements engages the stationary ground element to rotationally lock the eccentric shaft to the stationary ground element, and wherein the clutch actuator moves the clutch plate to the second position, wherein the clutch actuator moves the clutch plate toward the drive element of the engine, the second synchronizer frictionally engages the drive element of the engine to synchronize the rotational speed of the eccentric shaft to the rotational speed of the drive element of the engine, and at least one of the interference elements engages the drive element to rotationally lock the eccentric shaft to the drive element, wherein the rotational speed of the drive element of the engine is greater than the rotational speed of the stationary ground element.

11. The internal combustion engine of claim 10 wherein the rotational speed of the stationary ground element is zero, and the rotational speed of the drive element of the engine is one half the rotational speed of the crankshaft.

12. The internal combustion engine of claim 10 wherein the drive element further comprises:

a phaser that selectively adjusts a rotational position of the eccentric shaft relative to the crankshaft and infinitely adjusts a compression ratio of the internal combustion engine between a first predetermined compression ratio and a second predetermined compression ratio greater than the first predetermined compression ratio.

13. The internal combustion engine of claim 9 wherein the drive element further comprises:

a gearbox; and a phaser, wherein the gearbox is disposed on and coaxial with the eccentric shaft and selectively rotates the eccentric shaft at a rotational speed that is one of: one half of the rotational speed of the crankshaft, and the same as the rotational speed of the crankshaft, and wherein the phaser is disposed on and coaxial with the eccentric shaft, and selectively alters a rotational position of the eccentric shaft relative to a rotational position of the crankshaft to adjust a compression ratio of the internal combustion engine.

14. The internal combustion engine of claim 13 wherein the phaser adjusts a stroke length and a top dead center position of the piston inside the cylinder bore between at least a first length with a first top dead center position and a second length with a second top dead center position, the first length is smaller than the second length, the first top dead center position is between the second top dead center position and the crankshaft, the first length defines a first predetermined compression ratio and the second length defines a second predetermined compression ratio greater than the first predetermined compression ratio, and wherein the gearbox is one of a harmonic drive, a planetary gearset, and a roller reducer.

15. The internal combustion engine of claim 9 wherein a phaser adjusts a stroke length and a top dead center position of the piston inside the cylinder bore between at least a first length with a first top dead center position and a second length with a second top dead center position, the first length is smaller than the second length, the first top dead center position is between the second top dead center position and the crankshaft, the first length defines a first predetermined compression ratio and the second length defines a second predetermined compression ratio greater than the first predetermined compression ratio, and wherein the gearbox is one of a harmonic drive, a planetary gearset, and a roller reducer.

16. The internal combustion engine of claim 9 wherein the drive element further includes:

an input shaft rotatably supported by the engine block and parallel to the eccentric shaft;

a plurality of input shaft gears rotatably disposed on the input shaft;

a clutch plate disposed coaxially on the input shaft axially between the plurality of input shaft gears, the clutch plate including one or more interference elements extending outward from the clutch plate;

a first synchronizer disposed on the clutch plate and facing a first of the plurality of input shaft gears, and a second synchronizer disposed on the clutch plate opposite the first synchronizer and facing a second of the plurality of input shaft gears;

a plurality of eccentric shaft gears disposed on the eccentric shaft, each of the plurality of input shaft gears enmeshed with one of the plurality of eccentric shaft gears, defining a plurality of enmeshed input shaft gear and eccentric gear pairs, each enmeshed input shaft gear and eccentric shaft gear pair adapted to transfer rotational motion from the input shaft to the eccentric shaft at a predetermined gear ratio; and a clutch actuator adapted to selectively move the clutch plate axially along the input shaft between a first position and a second position, wherein in the first position the first synchronizer frictionally engages the first input shaft gear to synchronize a rotational speed of the input shaft to a rotational speed of the first input shaft gear, and at least one of the interference elements engages the first input shaft gear to rotationally lock the input shaft to the first input shaft gear, and wherein the clutch actuator moves the clutch plate to the second position, wherein the clutch actuator moves the clutch plate towards the second input shaft gear and the second synchronizer frictionally engages the second input shaft gear to synchronize a rotational speed of the input shaft to a rotational speed of the second input shaft gear, and at least one of the interference elements engages the second input shaft gear to rotationally lock the input shaft to the second input shaft gear, wherein rotational motion of the input shaft is transferred through the one of the plurality of input shaft gears to the enmeshed one of the plurality of eccentric shaft gears, and to the eccentric shaft, wherein a first of the plurality of enmeshed input shaft gear and eccentric shaft gear pairs rotates the eccentric shaft at one half of the rotational speed of the crankshaft, and a second of the plurality enmeshed input shaft gear and eccentric gear pairs rotates the eccentric shaft at the same rotational speed as the crankshaft.

17. An internal combustion engine comprising:

an engine block defining a cylinder bore;

a piston slidably supported within the cylinder bore, wherein the piston slides reciprocally within the cylinder bore throughout an engine cycle, including a piston compression stroke having a compression stroke length and a piston expansion stroke having an expansion stroke length;

a crankshaft rotatably supported by the engine block and rotatable about a crank axis;

an eccentric shaft rotatably supported within the engine and rotatable about an eccentric shaft axis, wherein the eccentric shaft axis is parallel to and distal from the crank axis;

an input shaft rotatably supported by the engine block and parallel to the eccentric shaft;

a plurality of input shaft gears rotatably disposed on the input shaft;

a clutch plate disposed coaxially on the input shaft axially between the plurality of input shaft gears, the clutch plate including one or more interference elements extending outward from the clutch plate;

a first synchronizer disposed on the clutch plate and facing a first of the plurality of input shaft gears;

a second synchronizer disposed on the clutch plate opposite the first synchronizer and facing a second of the plurality of input shaft gears;

a plurality of eccentric shaft gears disposed on the eccentric shaft, each of the plurality of input shaft gears enmeshed with one of the plurality of eccentric shaft gears, defining a plurality of enmeshed input shaft gear and eccentric gear pairs, each enmeshed input shaft gear and eccentric shaft gear pair adapted to transfer rotational motion from the input shaft to the eccentric shaft at a predetermined gear ratio; and a clutch actuator adapted to selectively move the clutch plate axially along the input shaft between a first position and a second position, wherein in the first position the first synchronizer frictionally engages the first input shaft gear to synchronize a rotational speed of the input shaft to a rotational speed of the first input shaft gear, and at least one of the interference elements engages the first input shaft gear to rotationally lock the input shaft to the first input shaft gear, and wherein the clutch actuator moves the clutch plate to the second position, wherein the clutch actuator moves the clutch plate towards the second input shaft gear and the second synchronizer frictionally engages the second input shaft gear to synchronize a rotational speed of the input shaft to a rotational speed of the second input shaft gear, and at least one of the interference elements engages the second input shaft gear to rotationally lock the input shaft to the second input shaft gear, wherein rotational motion of the input shaft is transferred through the one of the plurality of input shaft gears to the enmeshed one of the plurality of eccentric shaft gears, and to the eccentric shaft, wherein a first of the plurality of enmeshed input shaft gear and eccentric shaft gear pairs rotates the eccentric shaft at one half of the rotational speed of the crankshaft, and a second of the plurality enmeshed input shaft gear and eccentric gear pairs rotates the eccentric shaft at the same rotational speed as the crankshaft.

* * * * *